US005237758A

United States Patent [19]

Zachman

[11] Patent Number: 5,237,758

[45] Date of Patent: Aug. 24, 1993

[54] SAFETY SHOE SOLE CONSTRUCTION

[76] Inventor: Harry L. Zachman, P.O. Box 98, Lakebay, Wash. 98349

[21] Appl. No.: 864,563

[22] Filed: Apr. 7, 1992

[51] Int. Cl.[5] ..... A43B 13/12; A43B 13/00

[52] U.S. Cl. ..... 36/32 R; 36/107; 36/25 R

[58] Field of Search ..... 36/25 R, 25 A, 30 R, 36/30 A, 32 R, 32 A, 103, 107, 108

[56] References Cited

U.S. PATENT DOCUMENTS

| | | | |
|---|---|---|---|
| 1,272,556 | 7/1918 | Steward | 36/25 R |
| 1,701,611 | 2/1929 | Glidden et al. | 36/32 R |
| 1,704,187 | 3/1929 | Glidden et al. | 36/32 R |
| 1,791,177 | 2/1931 | Van Tassel, Jr. | 36/32 R |
| 2,349,975 | 5/1944 | MacKenzie | 36/32 R |
| 2,364,134 | 12/1944 | Dow et al. | 36/25 R |
| 2,367,481 | 1/1945 | Burger | 36/25 R |
| 2,386,667 | 10/1945 | Doherty | 36/32 R |
| 4,561,195 | 12/1985 | Unoda et al. | 36/30 R |
| 4,598,487 | 7/1986 | Misevich | 36/28 |
| 4,651,445 | 3/1987 | Hannibal | 36/103 |

*Primary Examiner*—Steven N. Meyers
*Attorney, Agent, or Firm*—Leon Gilden

[57] ABSTRACT

A safety shoe is arranged to have a shoe sole coextensive with a shoe upper extending upwardly of the shoe sole. The shoe sole includes at least one metallic fabric mesh web projected substantially coextensive through the shoe sole to minimize puncturing and projecting of the shoe sole to afford protection to an individual's foot within the associated shoe. A modification of the invention includes webs of intersecting construction having intersecting semi-elliptical sections intersecting at loops with adjacent webs of adjacent loops intersecting with flexible rods directed through the intersecting loops to minimize lateral displacement of adjacent fabric webs.

2 Claims, 4 Drawing Sheets

SAFETY SHOE SOLE CONSTRUCTION

BACKGROUND OF THE INVENTION

1. Field of the Invention

The field of invention relates to shoe sole construction, and more particularly pertains to a new and improved safety shoe sole construction to prevent puncturing of the shoe sole affording Protection to an individual's foot.

2. Description of the Prior Art

Various shoes of various configurations and construction are available in the prior art to afford protection to wearers thereof. Such a safety shoe is indicated in the U.S. Pat. No. 4,574,497 to Jindra wherein a relative rigid material is imbedded and surrounded by the outer sole.

U.S. Pat. No. 4,908.963 to Krajcir sets forth a safety shoe including a molded plastic arch extending across the matatarsal area to support each of its ends on the sole.

U.S Pat. No. 3,561,140 to Ludwig includes a safety sole with at least one non-skid surface mounted thereon.

U.S. Pat. No. 4,870,762 to Lee sets forth a safety shoe having a protective cap mounted above the toe of the shoe.

As such, it may be appreciated that there continues to be a need for a new and improved safety shoe sole construction as set forth by the instant invention which addresses both the problems of ease of use as well as effectiveness in construction in effecting prevention of puncturing of the shoe sole and in this respect, the present invention substantially fulfills this need.

SUMMARY OF THE INVENTION

In view of the foregoing disadvantages inherent in the known types of shoe construction now present in the prior art, the present invention provides a safety shoe sole construction wherein the same is arranged to include metallic fabric webs of intersecting mesh construction preventing puncturing of the sole and preventing injury to an individual's foot therewithin. As such, the general purpose of the present invention, which will be described subsequently in greater detail, is to provide a new and improved safety shoe sole construction which has all the advantages of the prior art shoe construction and none of the disadvantages.

To attain this, the present invention provides a safety shoe arranged to have a shoe sole coextensive with a shoe upper extending upwardly of the shoe sole. The shoe sole includes at least one metallic fabric mesh web projected substantially coextensive through the shoe sole to minimize puncturing and projecting of the shoe sole to afford protection to an individual's foot within the associated shoe. A modification of the invention includes webs of intersecting construction having intersecting semi-elliptical sections intersecting at loops with adjacent webs of adjacent loops intersecting with flexible rods directed through the intersecting loops to minimize lateral displacement of adjacent fabric webs.

My invention resides not in any one of these features per se, but rather in the particular combination of all of them herein disclosed and claimed and it is distinguished from the prior art in this particular combination of all of its structures for the functions specified.

There has thus been outlined, rather broadly, the more important features of the invention in order that the detailed description thereof that follows may be better understood, and in order that the present contribution to the art may be better appreciated. There are, of course, additional features of the invention that will be described hereinafter and which will form the subject matter of the claims appended hereto. Those skilled in the art will appreciate that the conception, upon which this disclosure is based, may readily be utilized as a basis for the designing of other structures, methods and systems for carrying out the several purposes of the present invention. It is important, therefore, that the claims be regarded as including such equivalent constructions insofar as they do not depart from the spirit and scope of the present invention.

Further, the purpose of the foregoing abstract is to enable the U.S. Patent and Trademark Office and the public generally, and especially the scientists, engineers and practitioners in the art who are not familiar with patent or legal terms or phraseology, to determine quickly from a cursory inspection the nature and essence of the technical disclosure of the application. The abstract is neither intended to define the invention of the application, which is measured by the claims, nor is it intended to be limiting as to the scope of the invention in any way.

It is therefore an object of the present invention to provide a new and improved safety shoe sole construction which has all the advantages of the prior art shoe construction and none of the disadvantages.

It is another object of the present invention to provide a new and improved safety shoe sole construction which may be easily and efficiently manufactured and marketed.

It is a further object of the present invention to provide a new and improved safety shoe sole construction which is of a durable and reliable construction.

An even further object of the present invention is to provide a new and improved safety shoe sole construction which is susceptible of a low cost of manufacture with regard to both materials and labor, and which accordingly is then susceptible of low prices of sale to the consuming public, thereby making such safety shoe sole construction economically available to the buying public.

Still yet another object of the present invention is to provide a new and improved safety shoe sole construction which provides in the apparatuses and methods of the prior art some of the advantages thereof, while simultaneously overcoming some of the disadvantages normally associated therewith.

These together with other objects of the invention, along with the various features of novelty which characterize the invention, are pointed out with particularity in the claims annexed to and forming a part of this disclosure. For a better understanding of the invention, its operating advantages and the specific objects attained by its uses, reference should be had to the accompanying drawings and descriptive matter in which there is illustrated preferred embodiments of the invention.

BRIEF DESCRIPTION OF THE DRAWINGS

The invention will be better understood and objects other than those set forth above will become apparent when consideration is given to the following detailed description thereof. Such description makes reference to the annexed drawings wherein.

DESCRIPTION OF THE PREFERRED EMBODIMENT

Figure 1:
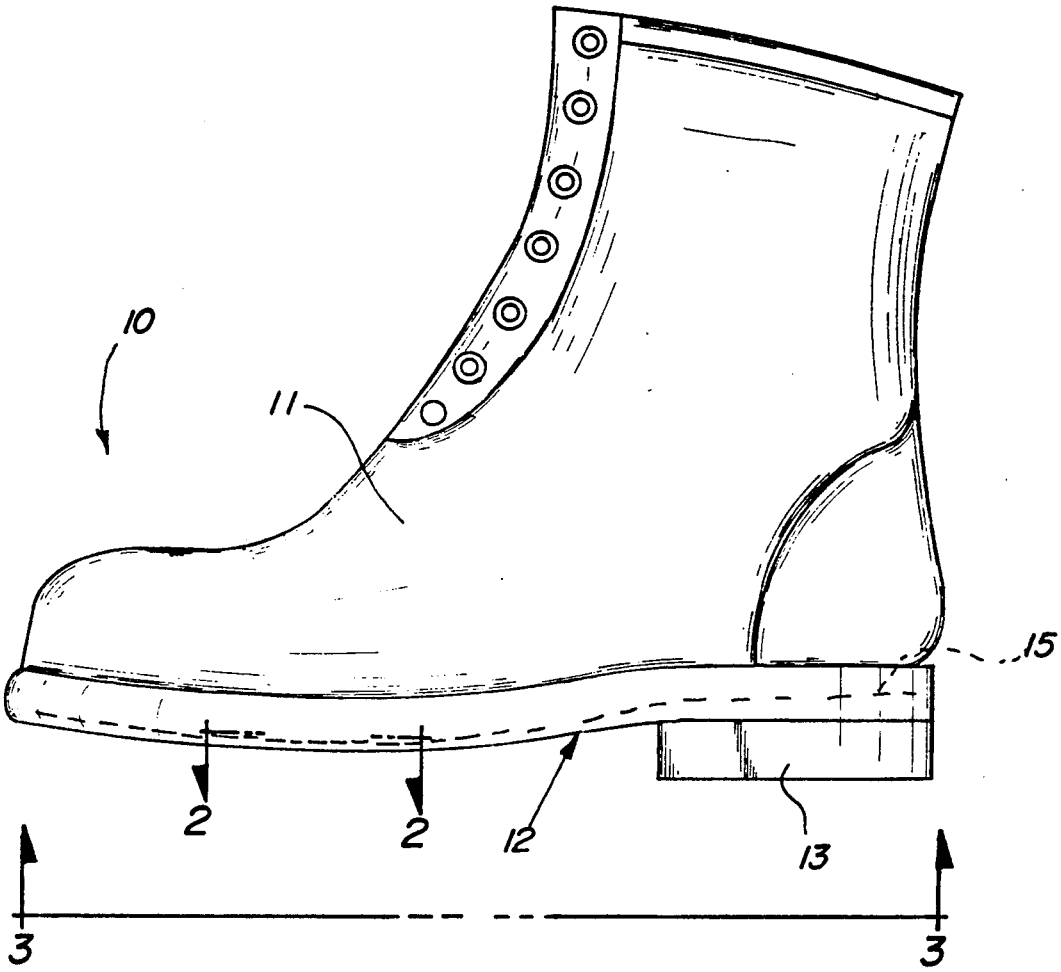
FIG. 1 is an orthographic side view of the instant invention.
Figure 2:
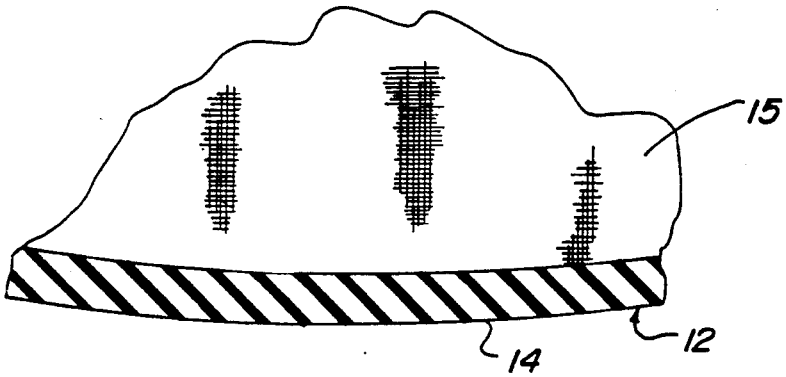
FIG. 2 is an orthographic view, taken along the lines 2—2 of FIG. 1 in the direction indicated by the arrows.
Figure 3:
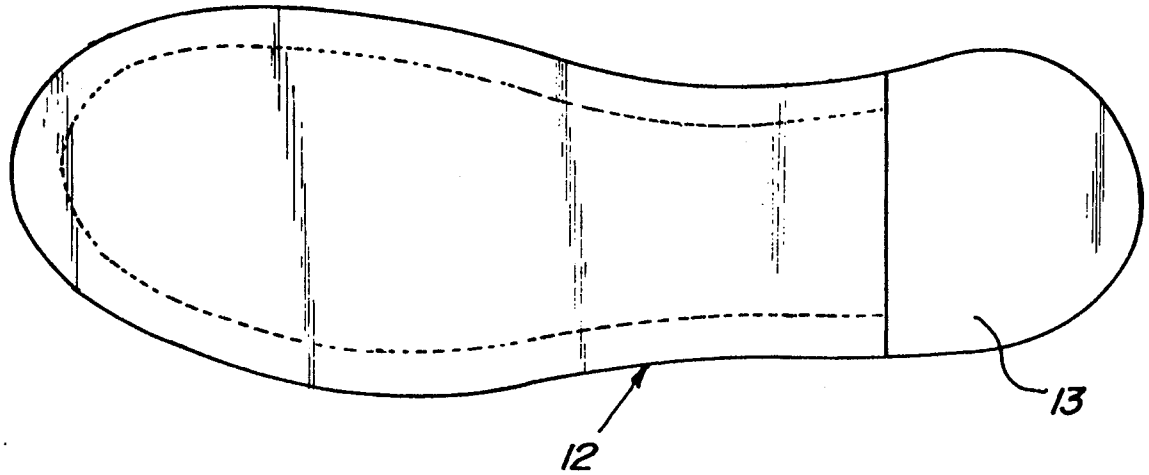
FIG. 3 is an orthographic view, taken along the lines 3—3 of FIG. 1 in the direction indicated by the arrows.

With reference now the drawings, and in particular to FIGS. 1 to 8 thereof, a new and improved safety shoe sole construction embodying the principles and concepts of the present invention and generally designated by the reference numeral 10 will be described.

More specifically, the safety shoe sole construction 10 of the instant invention essentially comprises a flexible shoe sole 12 having a shoe upper 11 mounted to the shoe sole 12 extending upwardly thereof, with the shoe sole further arranged to include a heel 13 below the shoe sole in a conventional configuration.

Within the shoe sole 12 is at least one metallic fabric mesh web 15 imbedded within the shoe sole between the sole's top and bottom surfaces and within the outer periphery 14 of the shoe sole, to enclose the web construction preventing inadvertent and accidental piercing of the shoe sole by various foreign objects, such as nails, spikes, and the like.

Figure 4:
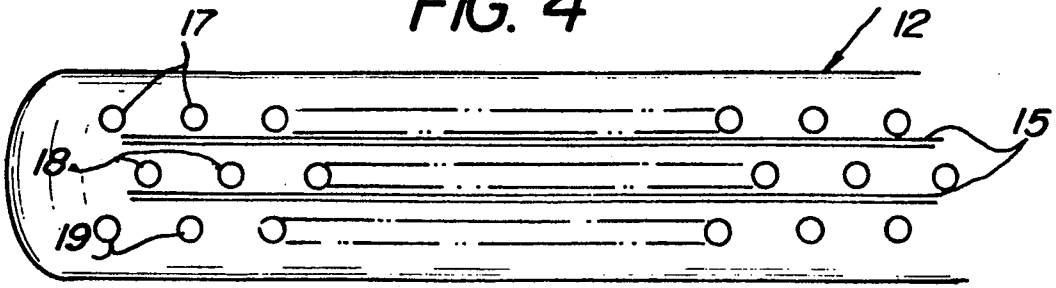
FIG. 4 is an orthographic cross-sectional illustration diametrically illustrating a plurality of webs and reinforcing rods utilized by the shoe construction.

FIG. 4 illustrates the use of a plurality of rows of reinforcing flexible rods, wherein the rods are formed of a shape-retentent material and arranged in offset relationship relative to one another between adjacent rows to provide for further geometric integrity of the flexible webs in their orientation within the shoe sole structure 12. The flexible rods are indicated by respective first, second, and third rod rows 17, 18, and 19, with each of the rods arranged in a parallel relationship relative to one another, with adjacent rods of adjacent rows in an offset relationship as illustrated to effect stability of the mesh webs 15 in their orientation within the shoe sole.

Figure 5:
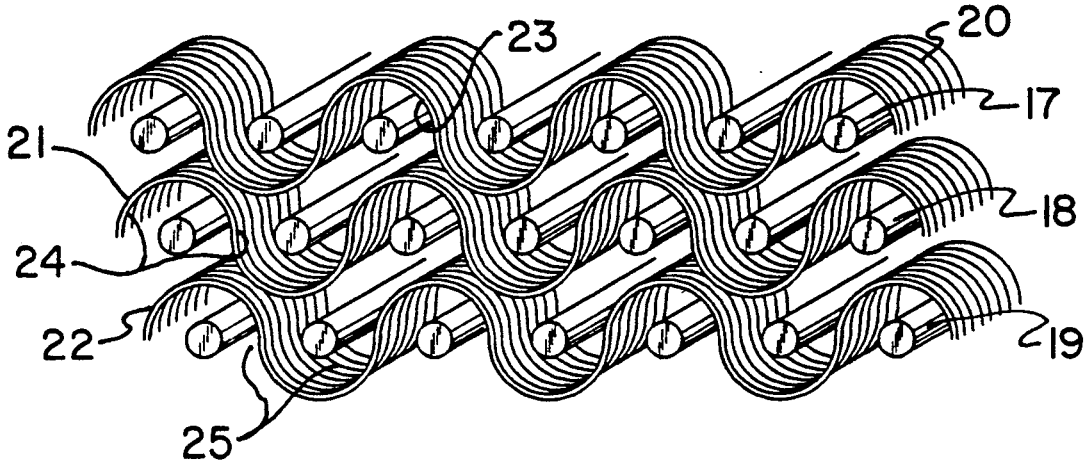
FIG. 5 is an isometric illustration of a modified interrelated mesh web and reinforcing rod construction of the shoe of the invention.

The FIG. 5 illustrates the use of the respective first, second, and third sinusoidal fabric webs 20, 21, and 22 respectively, wherein the sinusoidal webs are displaced linearly relative to one another, with the sinusoidal webs having respective first, second, and third web troughs 23, 24, and 25, with individual rods of the respective first, second, and third rod rows 17, 18, and 19 positioned within each respective trough of each web. In this manner, stability of the web structures and their geometric integrity within the shoe sole 12 is greatly enhanced.

Figure 6:
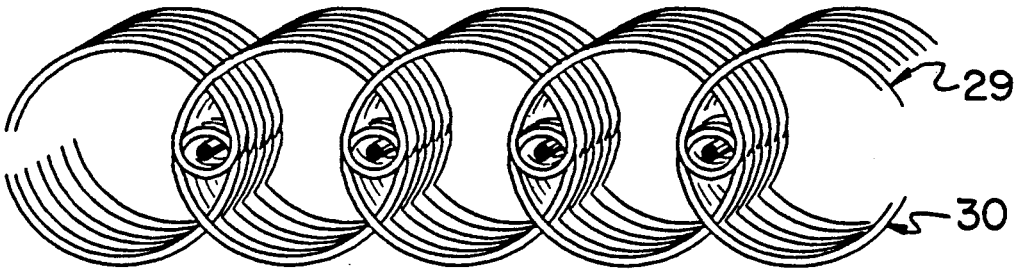
FIG. 6 is a further modification of the invention illustrating intersecting webs.
Figure 7:
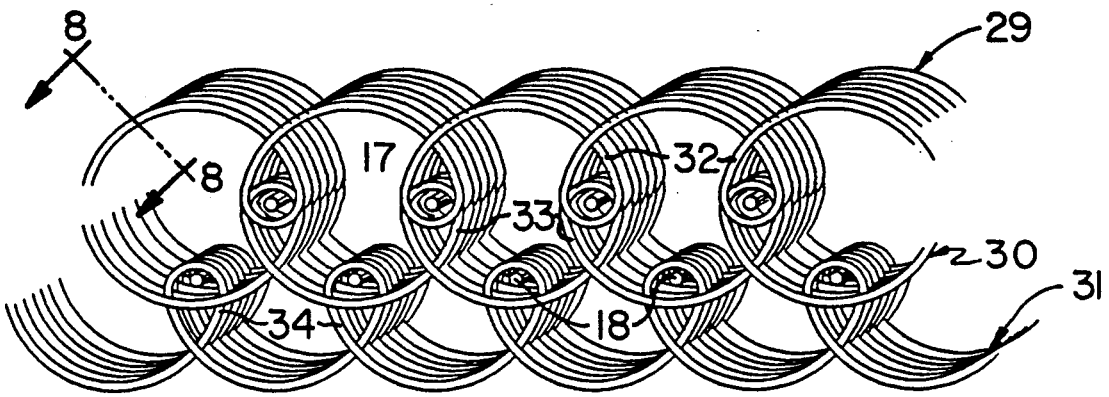
FIG. 7 is an isometric illustration of the invention illustrating a plurality of parallel intersecting webs having reinforcing rods positioned through intersecting loops of each of the webs.
Figure 8:
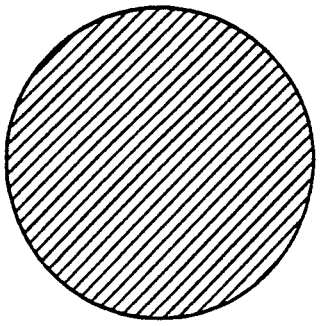
FIG. 8 is an orthographic view, taken along the lines 8—8 of FIG. 7 in the direction indicated by the arrows illustrating the metallic construction of each of the fibers of the fabric webs.

The FIGS. 6 and 7 note the use of the first, second, and third mesh fabric webs 26, 27, and 28 formed of a plurality of semi-elliptical segments whose ends intersect to form intersecting loops, with the first elliptical web 29 having first loops 32 intersecting second loops 33 of the second web 30. The third web 31 has third loops 34 intersecting and projecting through the semi-elliptical section of the third web. In this manner, first rods 17 are directed through the intersection of the first and second loops in a parallel relationship, with the second rods 18 offset relative to the first rods in the underlying row directed through the third loops in their projection above the semi-elliptical sections of the second web. The stability and piercing resistance of this structure is thus greatly enhanced in the use of a shoe sole construction.

As to the manner of usage and operation of the instant invention, the same should be apparent from the above disclosure, and accordingly no further discussion relative to the manner of usage and operation of the instant invention shall be provided.

With respect to the above description then, it is to be realized that the optimum dimensional relationships for the parts of the invention, to include variations in size, materials, shape, form, function and manner of operation, assembly and use, are deemed readily apparent and obvious to one skilled in the art, and all equivalent relationships to those illustrated in the drawings and described in the specification are intended to be encompassed by the present invention.

Therefore, the foregoing is considered as illustrative only of the principles of the invention. Further, since numerous modifications and changes will readily occur to those skilled in the art, it is not desired to limit the invention to the exact construction and operation shown and described, and accordingly, all suitable modifications and equivalents may be resorted to, falling within the scope of the invention.

What is claimed as being new and desired to be protected by Letters Patent of the United States is as follows:

1. A safety shoe sole construction, comprising, an elongate, flexible shoe sole, the shoe sole including a top surface spaced from a bottom surface, the top surface including a shoe upper mounted thereto, and a metallic fabric mesh web imbedded within the shoe sole between the top surface and the bottom surface, with the shoe sole having an outer periphery and the at least one fabric mesh web contained within the outer periphery, and a first row of first rods, wherein the first rods are arranged in a parallel relationship relative to one another, and a second row of second rods, wherein the second rods are arranged in a parallel relationship relative to one another parallel to the first rods, and the at least one fabric mesh web is formed with a plurality of web first enclosed loops, and a second mesh web adjacent the at least one fabric mesh web, including a plurality of second loops, and wherein the first loops and the second loops intersect, and at least one first rod of said plurality of first rods is directed through each intersection of each first loop and second loop of said first loops and said second loops.

2. A shoe sole construction as set forth in claim 1 including a third mesh web formed of a plurality of third enclosed loops, the third enclosed loops intersect and project through the second mesh web, with each third loop intersecting the second mesh web between the first loops and the second loops, and at least one second rods of said plurality of second rods is directed through said third loops above the third web.

* * * * *